US009863110B2

(12) United States Patent
Li

(10) Patent No.: US 9,863,110 B2
(45) Date of Patent: Jan. 9, 2018

(54) SUBSEA SYSTEM FOR THE INSTALLATION, SUSPENSION AND REMOVAL OF PRODUCTION AND PROCESSING EQUIPMENT

(71) Applicant: Zhen Li, Houston, TX (US)

(72) Inventor: Zhen Li, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 41 days.

(21) Appl. No.: 14/976,833

(22) Filed: Dec. 21, 2015

(65) Prior Publication Data

US 2016/0251816 A1 Sep. 1, 2016

Related U.S. Application Data

(60) Provisional application No. 62/121,068, filed on Feb. 26, 2015.

(51) Int. Cl.

| | |
|---|---|
| ***E02B 17/04*** | (2006.01) |
| ***E02B 17/06*** | (2006.01) |
| ***E02B 17/02*** | (2006.01) |
| ***E02B 17/08*** | (2006.01) |
| ***B63B 22/06*** | (2006.01) |

(Continued)

(52) U.S. Cl.

CPC ..... *E02B 17/06* (2013.01); *B63B 22/06* (2013.01); *B63B 22/20* (2013.01); *E02B 17/02* (2013.01); *E02B 17/08* (2013.01); *B63C 7/08* (2013.01)

(58) Field of Classification Search

CPC ..... E02B 17/02; E02B 17/08; E02D 27/52; B63B 22/06; B63B 22/28

See application file for complete search history.

(56) References Cited

U.S. PATENT DOCUMENTS 3,412,564 A * 11/1968 McClintock ..... E02B 17/02 405/208
3,545,215 A 12/1970 Burrus
3,550,385 A 12/1970 Lowd (Continued)

FOREIGN PATENT DOCUMENTS

GB 2 466 377 6/2010
WO WO 2010/021907 2/2010

(Continued)

*Primary Examiner* — Benjamin F Fiorello

(74) *Attorney, Agent, or Firm* — ExxonMobil Upstream Research Company—Law Department

(57) ABSTRACT

A subsea system for installing, suspending and removing underwater equipment below the surface of the sea is provided. The subsea system includes a landing base module for landing and positioning underwater equipment thereupon, the landing base module comprising a base member and a first buoyancy system; and a second buoyancy system for affixing to the underwater equipment, the second buoyancy system having sufficient buoyancy to float the underwater equipment toward the surface of the sea when detached from the landing base module, wherein the underwater equipment includes a ballast system structured and arranged to permit the underwater equipment to be lowered onto the landing base module. A method for installing, suspending and removing underwater equipment below the surface of the sea and a kit of parts are also provided.

12 Claims, 5 Drawing Sheets

(51) Int. Cl.
*B63B 22/20* (2006.01)
*B63C 7/08* (2006.01)

(56) References Cited

U.S. PATENT DOCUMENTS

| | | | | | |
|---|---|---|---|---|---|
| 3,729,756 | A * | 5/1973 | Cook | E21B 17/012 166/350 |
| 3,754,380 | A | 8/1973 | McMinn | |
| 4,604,001 | A | 8/1986 | Wetmore | |
| 4,653,960 | A | 3/1987 | Chun | |
| 4,702,320 | A * | 10/1987 | Gano | E21B 19/002 166/341 |
| 5,707,178 | A * | 1/1998 | Srinivasan | B63B 9/065 405/223.1 |
| 6,640,901 | B1 | 11/2003 | Appleford | |
| 9,254,894 | B2 * | 2/2016 | Gu | E21B 19/002 |
| 2009/0232605 | A1 * | 9/2009 | Breivik | E21B 19/002 405/203 |
| 2013/0046126 | A1 | 2/2013 | Varney | |
| 2016/0059943 | A1 * | 3/2016 | Chitwood | B63C 7/02 114/51 |

FOREIGN PATENT DOCUMENTS

| | | |
|---|---|---|
| WO | WO 2014/130320 | 8/2014 |
| WO | WO 2015/022476 | 2/2015 |

* cited by examiner

SUBSEA SYSTEM FOR THE INSTALLATION, SUSPENSION AND REMOVAL OF PRODUCTION AND PROCESSING EQUIPMENT

CROSS-REFERENCE TO RELATED APPLICATION

This application claims the benefit of U.S. Provisional Patent Application 62/121,068, filed Feb. 26, 2015, entitled SUBSEA SYSTEM FOR THE INSTALLATION, SUSPENSION AND REMOVAL OF PRODUCTION AND PROCESSING EQUIMENT, the entirety of which is incorporated by reference herein.

FIELD

The present disclosure relates to subsea systems and methods for the installation, suspension and removal of underwater production and processing equipment.

BACKGROUND

Oil and gas production is pursuing opportunities in increasingly deeper waters, thus it is desirable to develop solutions that can enable efficient production from deepwater fields. Subsea production and processing systems have been qualified and applied at water depths of up to 2500 meters. However, there are challenges associated with deep water production and processing systems.

For example, deep water production and processing systems should be designed to endure the high pressure of the water columns acting upon them. If the water is too deep, the wall of the equipment may need to be too thick to be manufactured. To address this challenge, the industry has been pursuing compact technologies to reduce the size and wall thickness of the equipment. However, the performance of these compact systems is generally lower when compared to conventional systems and more complicated, which may introduce reliability issues over the long run. Another challenge of greater water depths is the difficulties of system maintenance and intervention. ROVs have limited intervention capability and the whole production and processing system may need to be retrieved for a thorough intervention, which can be cost prohibitive at greater water depths.

As such, there exists a desire to address the aforementioned problems and issues. Therefore, what is desired is a means to apply current qualified production and processing systems and technologies to greater water depths. The systems proposed will, advantageously, also be easier to maintain compared to conventional systems.

SUMMARY

In one aspect, disclosed herein is a subsea system. The subsea system includes a landing base module for landing and positioning underwater equipment thereupon, the landing base module comprising a base member and a first buoyancy system; and a second buoyancy system for affixing to the underwater equipment, the second buoyancy system having sufficient buoyancy to float the underwater equipment toward a surface of a sea when detached from the landing base module, wherein the underwater equipment includes a ballast system structured and arranged to permit the underwater equipment to be lowered onto the landing base module.

In another aspect, disclosed herein is a method of installing, suspending and removing underwater equipment. The method includes positioning a landing base module for landing and positioning the underwater equipment thereupon, the landing base module comprising a base member and a first buoyancy system; affixing mooring lines to the landing base module to secure the landing base module between a surface and a floor of a sea; attaching a second buoyancy system to the underwater equipment, the second buoyancy system having sufficient buoyancy to float the underwater equipment toward the surface of the sea when detached from the landing base module; adding ballast to a ballast system of the underwater equipment to lower the underwater equipment having the second buoyancy system; and positioning the underwater equipment having the second buoyancy system attached thereto onto the landing base module.

In some embodiments, the method may include connecting the underwater equipment to one or more flowlines and risers.

In some embodiments, the method may include detaching the underwater equipment and second buoyancy system from the landing base module; and removing ballast to raise the underwater equipment and second buoyancy system to the surface of the sea.

In yet another aspect, disclosed herein is a kit of parts for installing, suspending and removing underwater equipment below a surface of a sea, the underwater equipment including a ballast system. The kit of parts includes a landing base module for landing and positioning the underwater equipment thereupon, the landing base module comprising a base member and a first buoyancy system; and a second buoyancy system for affixing to the underwater equipment, the second buoyancy system having sufficient buoyancy to float the underwater equipment toward the surface of the sea when detached from the landing base module.

In some embodiments, the landing base module further may comprise a plurality of mooring lines for affixing the landing base module to the floor of the sea.

In some embodiments, the first buoyancy system may comprise a syntactic foam core having a density sufficient to permit the landing base module to achieve a predetermined depth when the underwater equipment and second buoyancy system are attached thereto.

In some embodiments, the syntactic foam core of the first buoyancy system may be encapsulated by a polymeric material.

In some embodiments, the polymeric material may be selected from rotationally molded polyethylene, polyurethane elastomer, glass reinforced vinyl-ester, or combinations or mixtures thereof.

In some embodiments, the first buoyancy system may comprise one or more vessels filled with a material selected from air, gases, or liquids having a density less than the density of water, or combinations or mixtures thereof.

In some embodiments, the second buoyancy system may comprise a syntactic foam core having a density sufficient to permit the underwater equipment to float to the surface when the underwater equipment is detached from the landing base module.

In some embodiments, the syntactic foam core of the second buoyancy system may be encapsulated by a polymeric material.

In some embodiments, the polymeric material may be selected from rotationally molded polyethylene, polyurethane elastomer, glass reinforced vinyl-ester, or combinations or mixtures thereof.

In some embodiments, the landing base module may further comprise a plurality of connectors for connecting the underwater equipment to one or more flowlines and risers.

DETAILED DESCRIPTION

FIGS. 1-5 provide illustrative, non-exclusive examples of a method, system and kit of parts for installing, suspending and removing underwater equipment below the surface of the sea, according to the present disclosure, together with elements that may include, be associated with, be operatively attached to, and/or utilize such a method, system or kit of parts.

In FIGS. 1-5, like numerals denote like, or similar, structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

Although the approach disclosed herein can be applied to a variety of subterranean well designs and operations, the present description will primarily be related to bidirectional flow control devices for optimizing both production and stimulation or injection operations.

Figure 1:
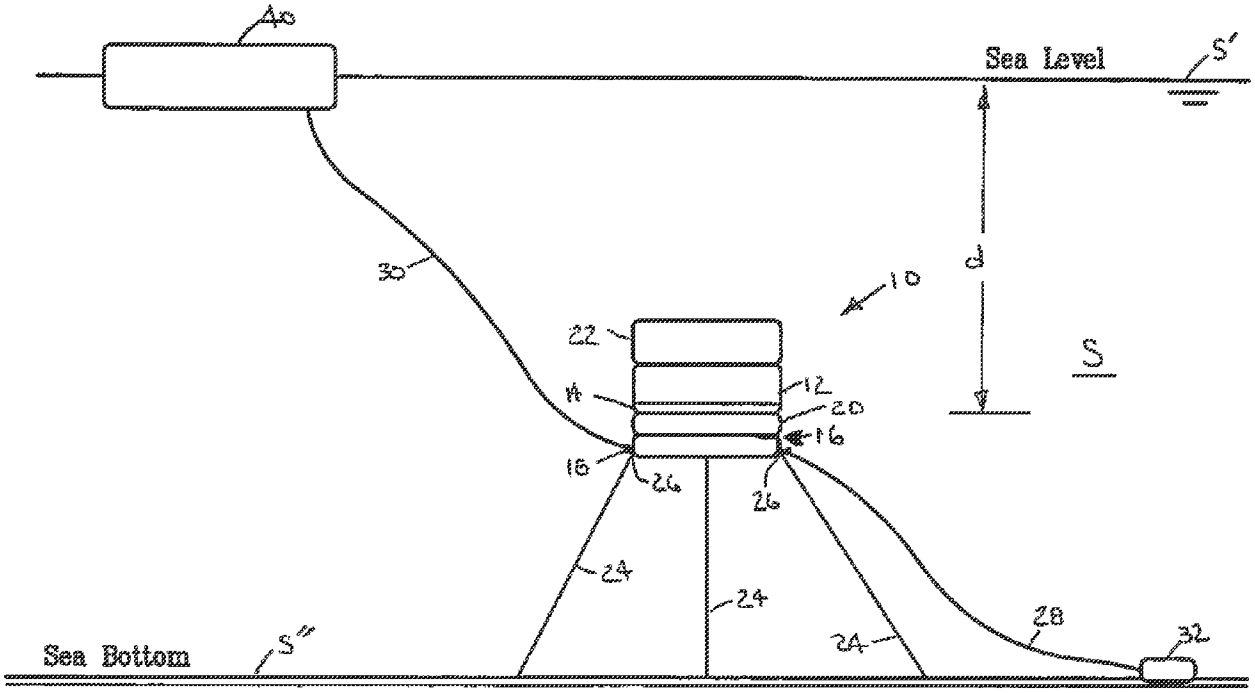
FIG. 1 presents a schematic view of an illustrative, nonexclusive example of a subsea system for installing, suspending and removing underwater equipment below the surface of the sea, according to the present disclosure.
Figure 2:
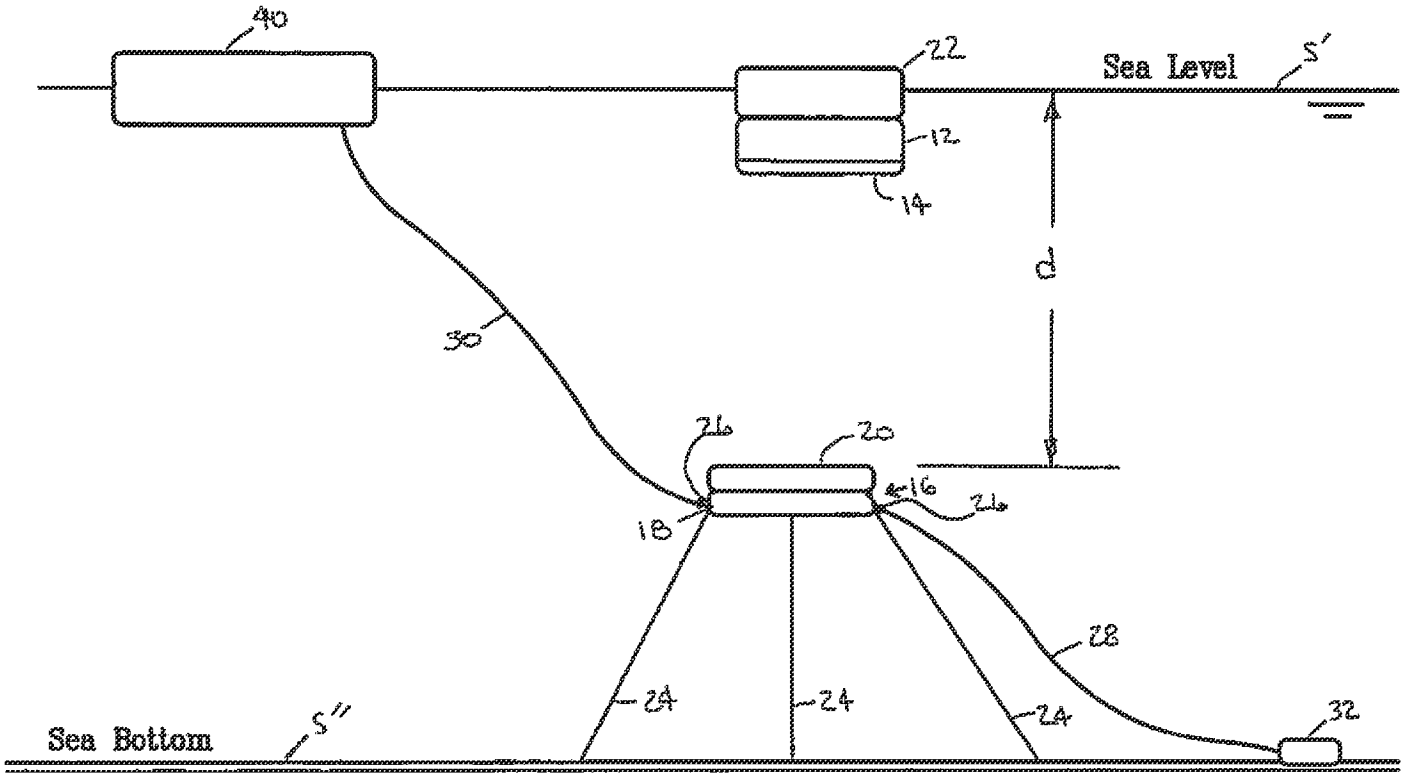
FIG. 2 presents a schematic view of an illustrative, nonexclusive example of the subsea system of FIG. 1, wherein the underwater equipment has been detached from its landing base and permitted to float to the surface of the sea, according to the present disclosure.

Referring now to FIGS. 1 and 2, illustrated is one embodiment of a subsea system 10 for installing, suspending and removing underwater equipment 12 below the surface S' of the sea S. In one embodiment, the underwater equipment 12 includes a ballast system 14. The ballast system 14 of the underwater equipment 12 is structured and arranged to permit the underwater equipment 14 to be lowered onto the landing base module by taking on sufficient ballast to sufficiently reduce the buoyancy inherent in the underwater equipment 12.

The subsea system 10 includes a landing base module 16 for landing and positioning the underwater equipment 12 thereupon. The landing base module 16 includes a base member 18 and a first buoyancy system 20.

The subsea system 10 also includes a second buoyancy system 22 for affixing to the underwater equipment 12. The second buoyancy system 22 is designed, structured and arranged so as to provide sufficient buoyancy to float the underwater equipment 12 toward the surface S' of the sea S, when detached from the landing base module 16, as shown in FIG. 2.

To maintain the position of the landing base module 16 with respect to the floor S" of the sea S, in some embodiments, the landing base module 16 of subsea system 10 may be provided with a plurality of mooring lines 24 for affixing the landing base module 16 to the floor S" of the sea S. In some embodiments, the landing base module 16 is provided with a plurality of connectors 26 for connecting the underwater equipment 12 to one or more flowlines 30 and risers 28. Flowlines 30 may connect the underwater equipment 12 to an operations vessel 40 and the risers 28 may connect the underwater equipment 12 to subsea equipment 32 (e.g., a subsea wellhead) located on the floor of the sea.

Figure 3:
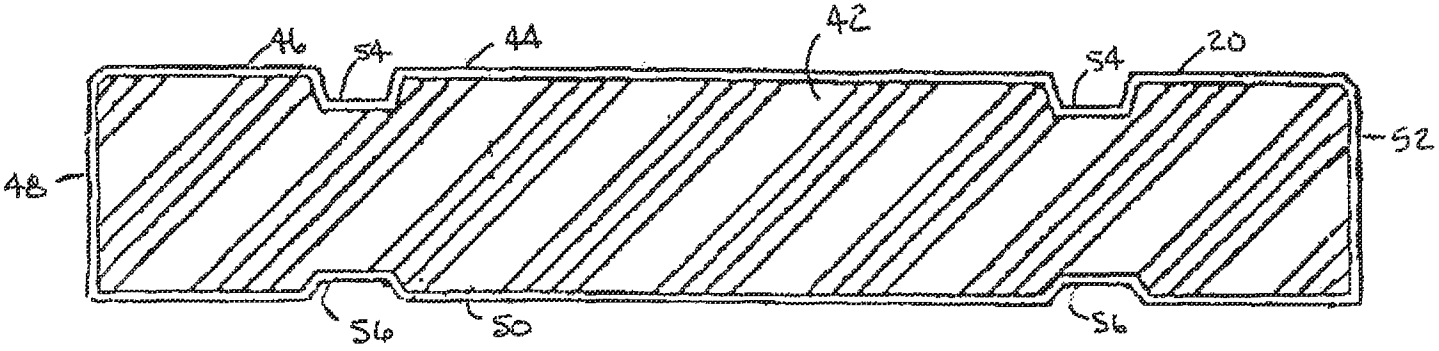
FIG. 3 presents a cross-sectional side elevation of an illustrative, nonexclusive example of a buoyancy system, according to the present disclosure.

Referring now to FIG. 3, in some embodiments, the first buoyancy system 20 includes a core 42 formed of a buoyant material. In some embodiments, first buoyancy system 20 may comprise a closed cell foam.

In some embodiments, the core 42 comprises a syntactic foam core having a density sufficient to permit the landing base module 16 to achieve a predetermined depth d when the underwater equipment 12 and second buoyancy system 22 are attached thereto (see FIGS. 1-2). Syntactic foams are composite materials synthesized by filling a metal, polymer, or ceramic matrix with hollow particles called microballoons. The presence of hollow particles results in lower density, higher specific strength (strength divided by density), lower coefficient of thermal expansion, and, in some cases, radar or sonar transparency.

As may be appreciated by those skilled in the art, syntactic foams may be designed to achieve a variety of different buoyancies and other properties. The matrix material can be selected from almost any metal, polymer, or ceramic. Microballoons are available in a variety of sizes and materials, including glass microspheres, cenospheres, carbon, and polymers. The most widely used foams are glass microspheres (in epoxy or other polymers), and cenospheres or ceramics in aluminum. To achieve the desired level of buoyancy, the volume fraction of microballoons may be changed and/or microballoons of different effective density may be used, the latter depending on the average ratio between the inner and outer radii of the microballoons.

The compressive properties of syntactic foams are a function of the properties of the microballoons. In general, the compressive strength is proportional to its density. The matrix material used to form syntactic foams influences the tensile properties. Tensile strength may be enhanced by chemical surface treatment of the particles, such as silanization, which allows the formation of strong bonds between glass particles and epoxy matrix. The addition of fibrous materials can also increase the tensile strength.

In some embodiments, macrosphere syntactic foam may be employed. Macrosphere syntactic foam integrates larger fiber-reinforced spheres (average diameter of 0.1875 inches or 5 millimeters (mm)) into the syntactic structure, thereby attaining lower densities in certain applications. Ideally suited for fabrication of larger standard sizes and custom structures, macrosphere syntactic foam may yield lower cost buoyancy for a given depth. Macrosphere foams are commercially available from Engineered Syntactic Systems of Attleboro, Massachusetts, and other sources.

Still referring to FIG. 3, the core 42 of the first buoyancy system 20 may be encapsulated by a shell 44, which, in some embodiments may comprise a polymeric material. In some embodiments, the polymeric material may be selected from rotationally molded polyethylene, polyurethane elastomer, glass reinforced vinyl-ester, or combinations or mixtures thereof. As depicted in FIG. 3, the shell 44 extends around the top and bottom outside surfaces 46 and 50 and the outside surfaces of sides 48 and 52 to fully encapsulate core 42.

A pair of grooves 54 may be formed in the top outer surface 46 of shell 44 to receive securing bands (not shown) or the like. Likewise, a pair of grooves 56 may be formed in the bottom outer surface 50 of shell 44 to receive securing bands or flexible resilient pads (not shown), as required.

Referring again to FIGS. 1 and 2, in some embodiments, the first buoyancy system 20 may include one or more substantially hollow vessels filled with a material selected from air, gases, or liquids having a density less than the density of water, or combinations or mixtures thereof.

Figure 4:
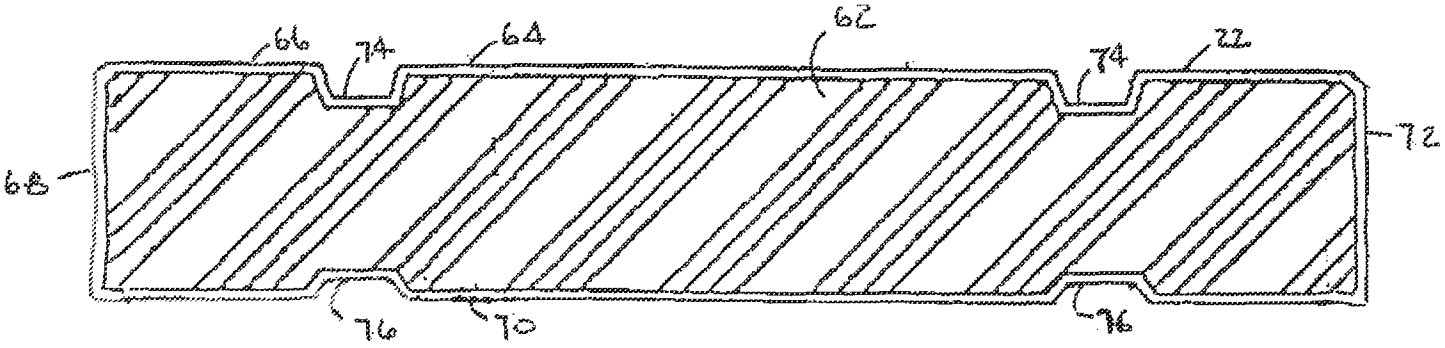
FIG. 4 presents a cross-sectional side elevation of another illustrative, nonexclusive example of a buoyancy system, according to the present disclosure.

Referring now to FIG. 4, in some embodiments, the second buoyancy system 22 includes a core 62 formed of a buoyant material. In some embodiments, second buoyancy system 22 may comprise a closed cell foam. In some embodiments, the core 62 comprises a syntactic foam core having a density sufficient to permit the underwater equipment 12 to float to the surface S' when the underwater equipment 12 is detached from the landing base module 16 (see FIG. 2). In some embodiments, macrosphere syntactic foam may be employed.

Still referring to FIG. 4, the core 62 of the second buoyancy system 22 may be encapsulated by a shell 64, which, in some embodiments may comprise a polymeric material. In some embodiments, the polymeric material may be selected from rotationally molded polyethylene, polyurethane elastomer, glass reinforced vinyl-ester, or combinations or mixtures thereof. As depicted in FIG. 4, the shell 64 extends around the top and bottom outside surfaces 66 and 70 and the outside surfaces of sides 68 and 72 to fully encapsulate core 62.

As with the first buoyancy system 20, the second buoyancy system 22 may be provided with a pair of grooves 74 formed in the top outer surface 66 of shell 64 to receive securing bands (not shown) or the like. Likewise, a pair of grooves 76 may be formed in the bottom outer surface 70 of shell 64 to receive securing bands or flexible resilient pads (not shown), as required.

Referring again to FIGS. 1 and 2, in some embodiments, the second buoyancy system 22 may include one or more substantially hollow vessels filled with a material selected from air, gases, or liquids having a density less than the density of water, or combinations or mixtures thereof.

Figure 5:
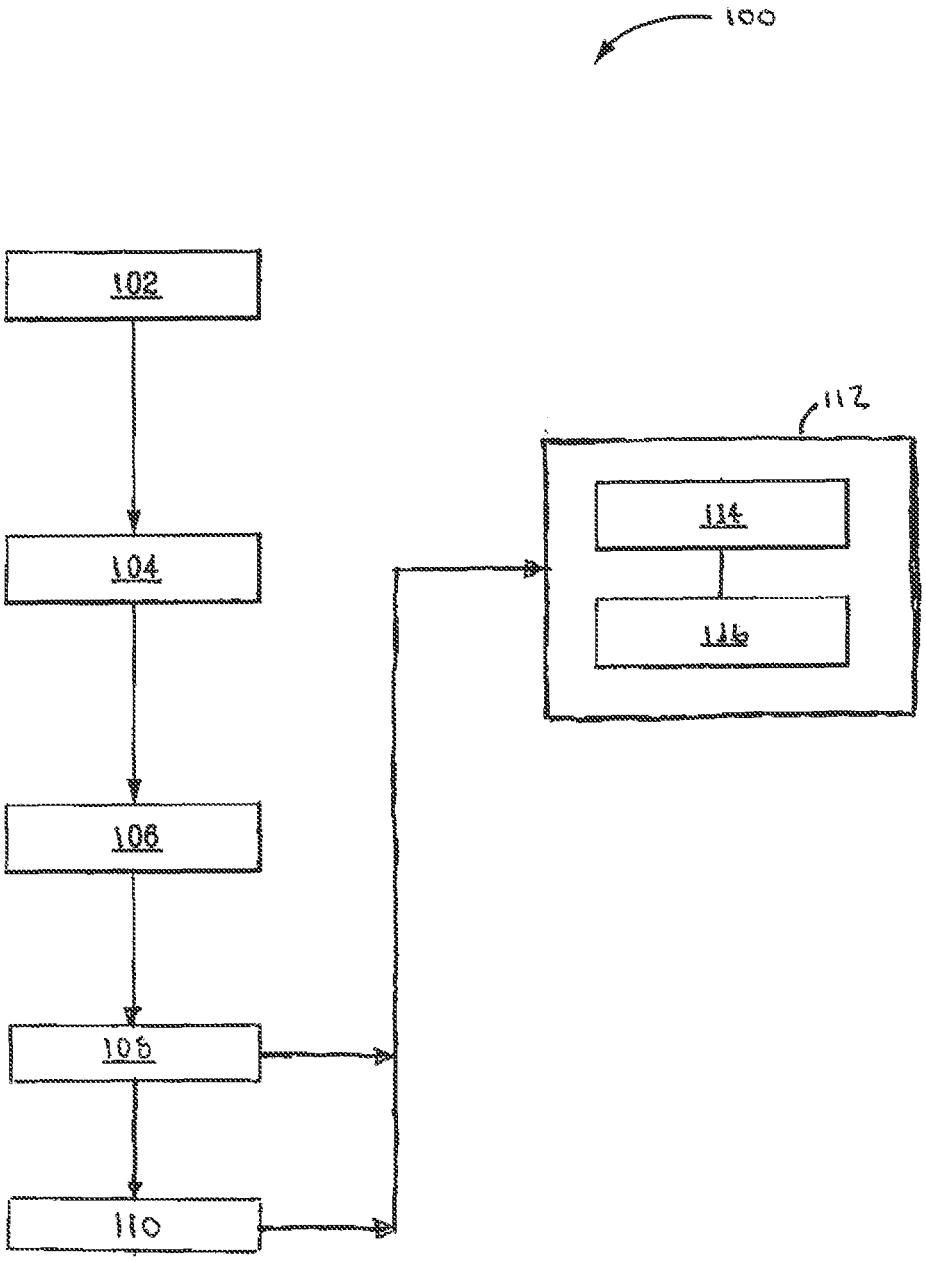
FIG. 5 presents a method of installing, suspending and removing underwater equipment, according to the present disclosure.

Referring now to FIG. 5, a method 100 of installing, suspending and removing underwater equipment, the underwater equipment including a ballast system, is presented. As shown, the method 100 includes 102, positioning a landing base module for landing and positioning the underwater equipment thereupon, the landing base module comprising a base member and a first buoyancy system; 104, affixing mooring lines to the landing base module to secure the landing base module between a surface and a floor of the sea; 106, attaching a second buoyancy system to the underwater equipment, the second buoyancy system having sufficient buoyancy to float the underwater equipment toward the surface of the sea when detached from the landing base module; 108, adding ballast to the ballast system of the underwater equipment to lower the underwater equipment having the second buoyancy system; and 110, positioning the underwater equipment having the second buoyancy system attached thereto onto the landing base module.

In some embodiments, 110 may further include connecting the underwater equipment to one or more flowlines and risers.

In some embodiments, the method may also include a process 112 for detaching and servicing underwater equipment. The process 112 may include 114, detaching the underwater equipment and second buoyancy system from the landing base module; and 116, removing ballast to raise the underwater equipment and second buoyancy system to the surface of the sea.

The maintenance and repair of the underwater equipment can be easily conducted on the sea surface without ROVs. After a maintenance and repair operation, the ballast system may be filled, so as to add additional weight, and the underwater equipment can sink down. In some embodiments, the underwater equipment may be guided by ROVs, or other means, to the base and then reconnected to the base member.

As may now be appreciated, there are several advantages of the disclosed for installing, suspending and removing underwater equipment. The systems and methods disclosed herein can adopt already qualified subsea production/processing systems/technologies to conduct operations at greater water depths. Also, the systems and methods disclosed herein are easier to maintain compared to conventional subsea systems located on the sea bottom, since the system can float to the sea surface without the help of lifting vessels once it is disconnected from the base structure. Furthermore, this idea can potentially reduce the cost of preparation of the sea bottom normally required to install the conventional subsea systems.

In field operations, it may be advantageous to provide a kit of parts. In this regard, disclosed herein is a kit of parts that includes a landing base module for landing and positioning the underwater equipment thereupon, the landing base module comprising a base member and a first buoyancy system; and a second buoyancy system for affixing to the underwater equipment, the second buoyancy system having sufficient buoyancy to float the underwater equipment toward a surface of the sea when detached from the landing base module.

In some embodiments, the landing base module further comprises a plurality of mooring lines for affixing the landing base module to the floor of the sea.

The first buoyancy system and second buoyancy system of the kit are as described herein.

In some embodiments, the landing base module further comprises a plurality of connectors for connecting the underwater equipment to one or more flowlines and risers.

As used herein, the term "sea" is meant to include any deep water body of water such as oceans, seas, and the like.

The embodiments disclosed herein, as illustratively described and exemplified hereinabove, have several beneficial and advantageous aspects, characteristics, and features. The embodiments disclosed herein successfully address and overcome shortcomings and limitations, and widen the scope, of currently known teachings with respect to deep sea production.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one" or "selected from" in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" or "selected from" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A subsea system comprising:

underwater equipment;

a landing base module for landing and positioning the underwater equipment thereupon, the landing base module comprising a base member, a first buoyancy system, a plurality of connectors for connecting the underwater equipment to one or more flowlines and risers, and a plurality of mooring lines to secure the landing base module between a surface of a sea and a floor of the sea; and a second buoyancy system for affixing to the underwater equipment, the second buoyancy system having sufficient buoyancy to float the underwater equipment toward the surface of the sea when detached from the landing base module;

wherein the underwater equipment includes a ballast system structured and arranged to permit the underwater equipment to be lowered onto the landing base module;

further wherein the flowlines connect the underwater equipment to an operations vessel at the surface of the sea; and further wherein the risers connect the underwater equipment to subsea equipment located on the floor of the sea.

2. The system of claim 1, wherein the first buoyancy system comprises a syntactic foam core having a density sufficient to permit the landing base module to achieve a predetermined depth when the underwater equipment and second buoyancy system are attached thereto.

3. The system of claim 2, wherein the syntactic foam core of the first buoyancy system is encapsulated by a polymeric material.

4. The system of claim 3, wherein the polymeric material is selected from rotationally molded polyethylene, polyurethane elastomer, glass reinforced vinyl-ester, or combinations or mixtures thereof.

5. The system of claim 1, wherein the first buoyancy system comprises one or more vessels filled with a material selected from air, gases, or liquids having a density less than the density of water, or combinations or mixtures thereof.

6. The system of claim 1, wherein the second buoyancy system comprises a syntactic foam core having a density sufficient to permit the underwater equipment to float to the surface when the underwater equipment is detached from the landing base module.

7. The system of claim 6, wherein the syntactic foam core of the second buoyancy system is encapsulated by a polymeric material.

8. The system of claim 7, wherein the polymeric material is selected from rotationally molded polyethylene, polyurethane elastomer, glass reinforced vinyl-ester, or combinations or mixtures thereof.

9. A method of installing, suspending and removing underwater equipment comprising:

positioning a landing base module for landing and positioning the underwater equipment thereupon, the landing base module comprising a base member and a first buoyancy system;

connecting the underwater equipment to one or more flowlines and risers using a plurality of connectors on the landing base module, wherein the flowlines connect the underwater equipment to an operations vessel at a surface of a sea, and the risers connect the underwater equipment to subsea equipment located on a floor of the sea;

affixing mooring lines to the landing base module to secure the landing base module between the surface of the sea and the floor of the sea;

attaching a second buoyancy system to the underwater equipment, the second buoyancy system having sufficient buoyancy to float the underwater equipment toward the surface of the sea when detached from the landing base module;

adding ballast to a ballast system of the underwater equipment to lower the underwater equipment having the second buoyancy system; and positioning the underwater equipment having the second buoyancy system attached thereto onto the landing base module.

10. The method of claim 9, further comprising detaching the underwater equipment and second buoyancy system from the landing base module; and removing ballast to raise the underwater equipment and second buoyancy system to the surface of the sea.

11. The method of claim 9, wherein the first buoyancy system comprises a syntactic foam core having a density sufficient to permit the landing base module to achieve a predetermined depth when the underwater equipment and second buoyancy system are attached thereto.

12. A kit of parts for installing, suspending and removing underwater equipment below a surface of a sea the kit of parts comprising:

a landing base module comprising a base member, a first buoyancy system, a plurality of connectors for connecting the underwater equipment to one or more flowlines and risers, and a plurality of mooring lines to secure the landing base module between the surface of the sea and a floor of the sea, wherein the flowlines connect the underwater equipment to an operations vessel at the surface of the sea, and the risers connect the underwater equipment to subsea equipment located on the floor of the sea; and a second buoyancy system, the second buoyancy system having sufficient buoyancy to float the underwater equipment toward a surface of the sea when detached from the landing base module.

* * * * *